US006415566B2

(12) United States Patent
Auer

(10) Patent No.: US 6,415,566 B2
(45) Date of Patent: Jul. 9, 2002

(54) MOBILE PARTITION

(75) Inventor: Karl-Heinz Auer, Burk (DE)

(73) Assignee: Preform Holding d.o.o., Ljublijana-polje (SI)

( * ) Notice: Subject to any disclaimer, the term of this patent is extended or adjusted under 35 U.S.C. 154(b) by 0 days.

(21) Appl. No.: 09/765,729

(22) Filed: Jan. 18, 2001

Related U.S. Application Data

(63) Continuation of application No. PCT/EP99/05261, filed on Jul. 23, 1999.

(30) Foreign Application Priority Data

Jul. 31, 1998 (EP) ..... 98114411

(51) Int. Cl.[7] ..... E04H 1/00
(52) U.S. Cl. ..... 52/238.1
(58) Field of Search ..... 52/238.1, 239, 52/483.1; 160/135, 351; 403/49

(56) References Cited

U.S. PATENT DOCUMENTS 3,571,999 A * 3/1971 Downing ..... 52/483.1
4,129,163 A * 12/1978 Johnson ..... 52/239

FOREIGN PATENT DOCUMENTS

| | | |
|---|---|---|
| CH | 662 601 | 10/1987 |
| DE | 26 02 210 A | 3/1977 |
| DE | 38 36 893 | 5/1990 |
| DE | 42 12 975 A | 10/1993 |
| EP | 0 053 933 A | 6/1982 |
| EP | 0 178 504 | 4/1986 |
| EP | 0 807 723 | 11/1997 |
| FR | 2 713 682 A | 6/1995 |
| GB | 2 154 622 A | 9/1985 |

* cited by examiner

*Primary Examiner*—Beth A. Stephan
(74) *Attorney, Agent, or Firm*—Katten Muchin Zavis Rosenman

(57) ABSTRACT

A mobile partition comprises at least one partition element (2) and at least one at least partly ferromagnetic support post (1). The partition element (2) has two vertical edge sections (6) which comprise magnetic systems (10) for joining the partition element (2) to the at least one support post (1). Said magnetic systems (10) are configured as magnetic strips (11) which extend substantially alongside the edge sections (6) and with their flat surfaces contact the corresponding support post (1). Each magnetic strip is inserted into a concave recess (13) in the edge sections (6) and presents non-magnetic edge areas.

11 Claims, 1 Drawing Sheet

MOBILE PARTITION

This is a continuation of PCT application Ser. No. PCT/EP99/05261 filed on Jul. 23, 1999.

FIELD OF THE INVENTION

This invention relates to a movable partition including at least one partition element and at least one, at least partially ferromagnetic, support post, in which the partition element has two upright edge sections which include magnetic systems extending essentially along the edge sections for joining the partition elements to at least one support post with the magnetic strip being flush on the support post.

BACKGROUND OF THE INVENTION

At different times, the use of magnetic attraction has been described for joining partition elements, with or without support posts. A movable partition is described in Swiss patent specification 662601 in which the partition elements have edge sections along which one or more permanent magnets, or if appropriate electromagnets, co-operate with ferromagnetic parts of the support post, thus joining the partition elements to the post.

European patent applications 0178504 and 0807723 describe movable partitions having partition elements joined, not with support posts, but directly to one another and again using magnetic attraction. Also the corresponding partition elements have edge sections with several magnetic fittings distributed along their lengths.

Although considered satisfactory, the preceding known movable partitions suffer from a serious disadvantage. To guarantee a sufficiently stable assembly of partition elements with support posts, relatively strong magnets must be used. As a result, frequently in practice it is found that in the region of the join between partition elements and support posts a stray magnetic field is detectable up to considerable distances from the partition. This creates a risk to the security of data stored on machine readable data carriers if such data carriers are in the proximity of this kind of partition. Similarly, a risk applies for example to the safe functioning of heart pace-makers.

To solve a similar problem for the free end of a movable partition in which the individual elements are directly joined with one another without a support post, it was proposed in European patent application 0807723 to neutralise the magnetic field by means of a short-circuit element which is located in contact with magnetic pole socket of the magnet arrangement. However this insert is not only expensive for solving the problem but is also unsuitable when joining a partition element with a support post because a sufficiently high magnetic force must be provided to give the partition sufficient stability.

In the earliest known prior art, EP-0053933 A1, a movable partition has a magnetic strip on the support post for joining a partition element to the post. Indeed, this configuration of magnetic arrangement has two features which contribute to an improvement of the stray field problem compared to the prior art described above. This is because the field strength of the magnetic arrangement is confined to the region between the magnetic arrangements and the support post, in contrast to multiple magnets which would have a greatly enlarged area of effect, but without having a disadvantageous effect on stability of the erected partition. Furthermore, the stray field is further reduced by the flat arrangement of the magnetic strip on the support post. Nevertheless, with this well known movable partition, it is not out of the question that stray magnetic fields spread outwards with the disadvantages described above.

SUMMARY OF THE INVENTION

The object of the present invention is to provide a movable partition of the generally known type that provides improved protection of stored data on machine-readable data carriers and which minimises risk to persons with heart pace-makers.

The object is achieved by the present invention by providing magnetic strips embedded in a concave arcuate deep recess in the edge sections of the partition elements, the strips having unmagnetised edge areas. For example, with a 20 mm wide strip, only a 15 mm central area is magnetised and the remaining edge areas remain unmagnetised. Having such unmagnetised edge areas in combination with embedding the magnetic strips into deep grooves in the edge sections can clearly increase the security against stray fields, compared to the present state of the technology. At the same time, the arrangement provides for special circumstances, for example if the partition is accessible only at one side, or an asymmetric magnetisation of the magnetic strip in question. This particular manner of influencing the stray magnetic fields in a simple possible manner in the respective related applications, is a distinct advantage of the present invention which is not attained in partitions of the known kind.

A first preferred embodiment of the invention is characterised in that, at the free end of the edge section of a partition not joined with a support post, there is fitted an infill piece which neutralises the magnetic field of the respective magnetic strip. Such an infill piece is of ferromagnetic material. The surface of the infill piece facing towards the edge section has a curve which is complementary to the curve of the support post. In this manner, a flush contact of the respective magnetic strip with the infill piece is guaranteed resulting in the greatest possible cancellation of stray fields.

In an embodiment of the present invention, the support post preferably has a round cross-section and the magnetic strips preferably have a corresponding complementary concave arcuate outer surface. The round cross-section of the support post makes it possible for partition elements to be joined with it in any position. However, the support posts and the magnetic strips are not limited to that particular shape. For example, the support posts may have a polygonal (e.g. octagonal) cross-section whereby in this case the magnetic strips have a flat planar outer surface.

In a further preferred embodiment of the invention, the magnetic strips are flexible. It is particularly preferred that the magnetic strips are planar in the relaxed state whereby they are inserted under a bias or compression into a concave arcuate groove in the edge section. This is of particular advantage in relation to manufacture because the production of planar magnetic strips is considerably more cost effective than the production of arcuate magnetic strips. The cost advantage arises when a magnetic strip that needs to have an arcuate form in its final condition, as described above, is first produced as a planar magnetic strip and later, because of its flexibility, adopts a compressed arcuate shape when mounted in the edge section.

For secure mounting on the edge section the magnetic strip has at least one connection rib, most preferably on its rear, which fits into a groove of the respective edge section. Such a connection rib may have a swallow-tail shaped cross-section guaranteeing a secure mounting of the (if applicable compressed) magnetic strips in the respective groove of the edge section. The connection rib may be solid, hollow or split. Cross-sectional shapes other than the projecting swallow-tail shape, e.g. T-shape, can have similar advantages.

In a further preferred embodiment of the invention, the wall thickness of the support posts is throughout their length at least 1.2 mm ferromagnetic material. With this specification, a magnetic flux arises within the support posts of such a strength that stray fields, even under unfavourable conditions, are reduced to an insignificant level.

The edge sections have as reinforcement a reinforcement rib, preferably located at a rear portion, which fits into a complementary slot provided in an edge strip extending along the respective partition body of the partition element. In this way, the same shape of edge section can be readily mounted on different partition bodies, which is advantageous for a cost-effective modular system.

In another preferred embodiment of the invention, at least one safety member to be fitted afterwards is provided on a combined partition element/support post assembly for fixing the two parts together. It is significant that the safety member need not be permanently connected to the partition element or to the support post, but rather that it is fitted separately, if desired flexibly or removably, with the assembly of the partition element and support post. This is achieved by the safety member being secured as a final operation to a joined partition element/support post assembly. With this arrangement the partition element with its magnetic strip adhering to the support post need not be displaced relative to the support post in order to mount the safety member in its operative fixing position. To achieve this, the safety member can act as a clip-on security clip particularly mounted from above the edge section and the support post.

BRIEF DESCRIPTION OF THE DRAWINGS

The present invention is further described with reference to the accompanying drawings of a preferred embodiment.

DETAILED DESCRIPTION OF THE PREFERRED EMBODIMENT

Figure 1:
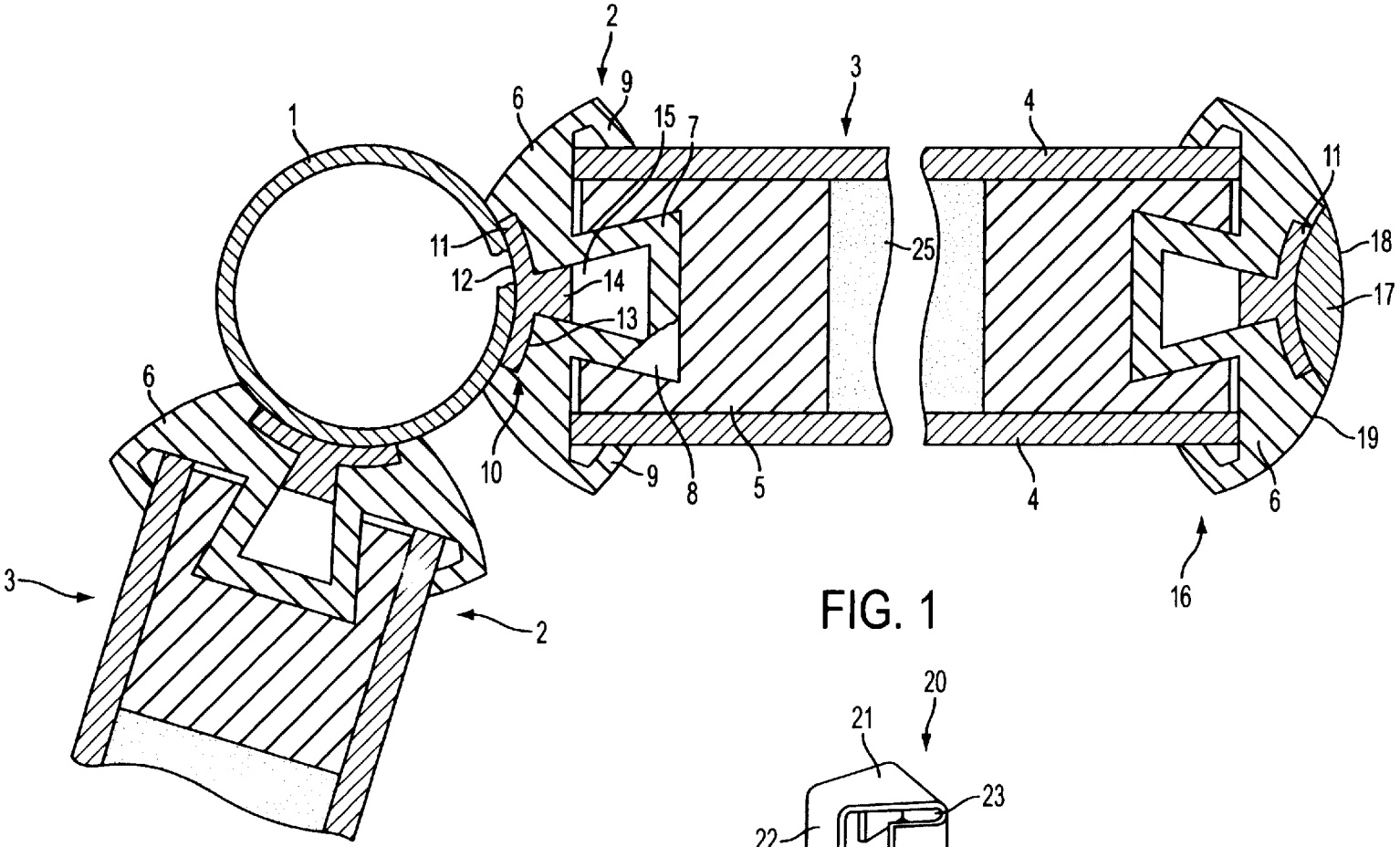
FIG. 1 shows a horizontal section through a support post and through two partition elements constituting a section of an erected movable partition according to the invention.

As shown in FIG. 1, two partition elements (2) are assembled with the support post (1). Each partition element (2) includes a partition body (3) made of two flax/rice straw sheets (4). Between the sheets (4) and extending along their height there are provided edge trims (5) made from MDF and also a filler material (25) having a honeycomb structure. Also, there are two vertical edge sections (6). Each edge section (6) has on its rear side a trapezium-shaped attachment rib (7) which fits into a complementary swallow-tail groove (8) in the edge trim (5). Furthermore, each edge section (6) is bounded by two flanges (9) which are located on the outside of the sheets (4) of the partition body (3). These flanges (9) are resiliently flexible in order to provide some compensating tolerance for receiving a partition body (3) having a thickness less than the nominally specified thickness.

For joining the partition elements (2), the support post (1) is made of ferromagnetic material and abuts on each edge section (6) which has a magnetic system (10) composed of a magnetic strip (11) extending along the respective edge section (6). These magnetic strips (11) have a generally flat configuration providing a concave arcuate outer surface (12) abuting the support post (1). The magnetic strips (11) are composed of a flexible support material which is planar in its relaxed state. The arcuate shape (12) forms as the magnetic strips are inserted under compression into the concave recesses (13) of the respective edge section (6). For secure mounting of the magnetic strip (11) in the respective edge section (6), the strip (11) has extending rearwardly a connection rib (14) which fits into a slot (15) of the respective edge section (6). The connection rib (14) has a trapezium-shaped cross-section complementary to the swallow-tail shape of the slot (15).

At the unattached end (16) of the partition, the relevant edge section (6) is provided with an infill piece (17) that has a generally lens-shaped cross-section. The infill piece (17) neutralises the magnetic field of the respective magnetic strip (11). The infill piece (17) is made of a ferromagnetic material. The magnetic strips (11) have concave outer surfaces with the same curvature as the support post (1) so that the magnetic strips (11) lie flush. The curvature of the outer surface (18) of the infill piece (17) corresponds to the curvature of the outer surface (19) of the edge section (6), whereby the infill piece is smoothly integrated visually into the edge section (6). The magnetic strips (11) are not magnetised over their entire width. Magnetisation is limited to the middle area which leaves the outer areas unmagnetised.

Figure 2:
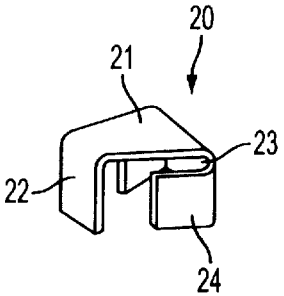
FIG. 2 shows a perspective view of a safety clip for fixing to an assembly of a support post and partition element after their assembly.

FIG. 2 shows a safety clip suitable for fixing onto a partition element (2) with its magnetic strip (11) adhering to a support post (1). The safety clip (20) includes a bridging piece (21) with two projections, one extending from one side thereof and forming an inner internal hook (22) and the other extending from the other side and forming an outer hook (23). The outer hook (23) has two projections (24) which are folded inwardly in the direction of the inner hook (22) to form a wedge-shape. The safety clip (20) is attached in its final position from above and onto a joined support post/partition element assembly so that the inner hook (22) engages the inside of the support post (1) and the outer hook with the projections (24) engages the slot (15) of the edge section (6). The safety clip (20) therefore secures the connection between the respective partition element (2) and the support post (1) supplementing the magnetic force operating between the magnetic strips (11) and the support post (1).

What is claimed is:

1. A movable partition comprising:

at least one partition element and at least one, at least partially ferromagnetic, support post, the at least one partition element having two upright edge sections and magnetic systems on each of said upright edge sections for joining the at least one partition element with the at least one said support post, each of said upright edge sections having a height, an edge area and a concave arcuate deep recess in said edge area, each magnetic system on each upright edge section further comprising a magnetic strip that extends substantially along the height of the upright edge section, wherein the magnetic strip has unmagnetized edge areas and is embedded in said concave arcuate deep recess, and wherein said magnetic strip lies flush with said at least one support post when said at least one partition element and said at least one support post are assembled together.

2. A movable partition according to claim 1, further comprising a neutralizing infill piece inserted in one of said upright edge sections when said one of said upright edge sections is not assembled adjacent said at least one support post.

3. A movable partition according to claim 1, wherein the at least one support post is round in cross-section and the magnetic strips have concave arcuate outer surfaces.

4. A movable partition according to claim 1, wherein the magnetic strips are flexible.

5. A movable partition according to claim 4, wherein the magnetic strips are planar prior to embedding into said recesses and when embedded in the recesses are under compression.

6. A movable partition according to claim 1, wherein each of the magnetic strips has a rear section and at least one connection rib provided on said rear section, which rib fits into a slot provided in said upright edge sections.

7. A movable partition according to claim 1, wherein the at least one support post has a wall thickness of at least 1.2 mm.

8. A movable partition according to claim 1, wherein each of said upright edge sections has an attachment rib on a rear portion of said upright edge sections, which attachment rib fits into a complementary groove provided in an edge trim of the at least one partition element.

9. A movable partition according to claim 1, further comprising at least one post-assembled safety member that is adapted to join said at least one partition element and said at least one post assembly for holding said at least one partition element and said at least one post assembly together.

10. A movable partition according to claim 9, wherein the safety member is shaped as a clip-on safety clip and is adapted to attach at a top of and onto the edge section and the at least one support post.

11. A movable partition according to claim 1, wherein said at least one partition element includes a partition body formed from two flax/rice straw sheets between which there are provided edge trims composed of MDF and a filler material having a honeycomb structure.

* * * * *